US007111736B2

(12) United States Patent
Petter

(10) Patent No.: US 7,111,736 B2
(45) Date of Patent: Sep. 26, 2006

(54) PACKAGE DECORATION WITH POP-UP DISPLAY

(75) Inventor: Marta Petter, 1725 N. Mohwark St., Suite 3 South, Chicago, IL (US) 60614

(73) Assignee: Marta Petter, Chicago, IL (US)

( * ) Notice: Subject to any disclaimer, the term of this patent is extended or adjusted under 35 U.S.C. 154(b) by 16 days.

(21) Appl. No.: 10/817,093

(22) Filed: Apr. 2, 2004

(65) Prior Publication Data

US 2004/0226847 A1 Nov. 18, 2004

Related U.S. Application Data

(60) Provisional application No. 60/459,675, filed on Apr. 2, 2003.

(51) Int. Cl.
*B65D 25/00* (2006.01)

(52) U.S. Cl. ..... 206/768; 206/457; 40/120.06; 40/120.08

(58) Field of Classification Search ..... 206/457, 206/232, 768, 45.8, 45.29; 40/120.02, 120.06, 40/120.08, 120.14, 132
See application file for complete search history.

(56) References Cited

U.S. PATENT DOCUMENTS 2,736,115 A * 2/1956 James ..... 40/312
3,026,639 A * 3/1962 Lille ..... 40/124.09
4,145,731 A * 3/1979 Adamich ..... 362/123
4,201,331 A * 5/1980 Austin ..... 229/140
4,293,601 A 10/1981 Cole
4,374,877 A * 2/1983 Cole ..... 428/9
4,627,640 A * 12/1986 Markovics ..... 281/5
4,726,509 A * 2/1988 Fonas ..... 229/116.1
4,774,780 A * 10/1988 Crowell ..... 40/124.08
4,784,314 A * 11/1988 Penick ..... 229/116.3
5,104,124 A 4/1992 Bernard et al.
5,452,846 A * 9/1995 Myers ..... 229/116.3
5,584,429 A 12/1996 Savage
5,613,612 A * 3/1997 Davault ..... 206/768
6,088,943 A 7/2000 Ramirez
D464,261 S * 10/2002 Hereth ..... D9/422

* cited by examiner

*Primary Examiner*—Jila M. Mohandesi
(74) *Attorney, Agent, or Firm*—McAndrews, Held & Malloy

(57) ABSTRACT

A package decoration having a foldable panel and pop-up decoration affixed to the panel. The panel and the pop-up decoration are foldable into a flat format, the pop-up decoration folding between folded portions of the panel. The pop-up decoration configured and printed, and the panel printed to provide an occasion specific decoration. The panel may include a printed greeting and other package wrappings, such as ribbons may also be included with the panel and pop-up decoration.

14 Claims, 3 Drawing Sheets

PACKAGE DECORATION WITH POP-UP DISPLAY

RELATED APPLICATIONS

This application claims priority to U.S. Provisional Application Ser. No. 60/459,675, filed Apr. 2, 2003.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

The present invention relates to package decoration and package wrapping, and more particularly to a decoration that is collapsed for convenient distribution and handling in a flat format, that opens to be affixed to a package and that expands or pops up when opened to provide a dimensional display.

Packages are decorated when given as gifts, displayed to attract attention, or in other circumstances in which a visually pleasing and/or interesting presentation is desired. Package decorations that are frequently affixed to packages include wrapping material, ribbon, and ornamentation including ribbons, bows, greeting cards, and other displays. Known distinctive package decorations include a dimensional flower-like ornament that is attached to a package by an elasticized cord as described by U.S. Pat. No. 4,293,601. Another dimensional decoration is a decorative pop out card accessory for attaching cards to a gift package that is disclosed by U.S. Pat. No. 6,088,943.

The time required to decorate a package can limit the extent and complexity of decoration when little time is available, when many packages are to be decorated, and when package decoration requires many steps such as cutting and applying wrapping material, wrapping with ribbon, and affixing cards or ornaments to the package. Various approaches have been used to make package decoration less time consuming. These include decorated gift bags, gift sleeves, gift bands, self-stick bows, and self-stick wrapping paper. Another approach to reducing the time required to wrap a package is attaching pre-cut wrapping paper to a box as disclosed for example by U.S. Pat. No. 5,584,429. These approaches make package decoration and gift wrapping less time consuming but are limited in the sizes of package that can be accommodated, in variety of decoration or wrapping that can be attached to a package, or a combination of these limitations.

Another limitation on package decoration is imposed by the necessity for shipping or otherwise transporting a package. Package decorations that are easily damaged or that occupy an unacceptable volume are unusable for packages that must be transported. A decoration that avoids such problems as disclosed by U.S. Pat. No. 4,374,877 is a dimensional decoration made of an expanding structure that may be folded into a compact configuration and quickly opened and secured to a package. That decoration has two end members that open along a spine or fold from a folded configuration and an accordion-like expansible structure between the end members including spokes that extend from the spine. The expansible structure expands when the end members are opened from the closed configuration to form a dimensional ornament. An elasticized cord is attached at its ends to the end members so that the cord can be wrapped onto the package. Accordion-like expansible decorations of the type disclosed by U.S. Pat. No. 4,374,877 provide limited forms of decorations.

More complex expanding displays have been used in pop-up books. Pop-up books have collapsed displays that open and expand to create a multi-dimensional and engaging displays that illustrates a book's story. Pop-up displays in books generally include one or more sheets, generally made from paper, that are folded when collapsed and expand when the book is opened at the display to form a three dimensional picture or model. Pop-up books have been known for many years. A pop-up display can form complex and diverse forms and can have movable pieces that add motion to the display. Pop-up displays are generally relatively fragile when opened and expanded. Pop-up displays therefore are distributed, as in books, in a folded or collapsed position often within a durable covering such as the cover of a book or overlying sheets.

In addition to illustrating stories in books, pop-up displays (often referred to simply as pop-ups) have also been used to enhance product displays. U.S. Pat. No. 5,104,124 discloses a paper pop-up that is permanently attached to a package and that creates a game. The pop-up game is formed by panels that fold over each other to collapse to a flat and compact form. One panel is glued to a product package and another panel folds from the attached panel to open the pop-up between the panels and form the game. Pop-up displays have not heretofore been adapted to provide dimensional or complex package decoration that can be quickly mounted to a package and have not been combined with package wrapping and decorating materials.

A need remains for decorations that can be quickly applied to packages and that can be appropriate for diverse themes and occasions. A need also exists for gift wrapping decorations that can be provided for a range of package sizes and shapes and that can be appropriate for many occasions. A need also exists for a package decoration that includes a dimensional decoration that can be transported and efficiently applied to a package.

BRIEF SUMMARY OF THE INVENTION

The present invention is a package decoration that is compact and durable when folded and collapsed for shipping and that is quickly and easily opened for application to a package. A dimensional pop-up package display expands from a generally flat folded panel to be affixed to a package. The pop-up display and in some cases the panel combine, by printing, configuration, or other aesthetic means, to provide a decoration that is appropriate for a holiday, occasion, or other desired theme. The dimensional pop-up display and the panel are made to be foldable into a compact and durable configuration for shipping and handling. While it is preferred that the pop-up display is affixed to and expands from the panel as the panel is opened, the pop-up display may be separate from the panel before the panel and pop-up display are applied to a package to provide a compact format for shipping. The panel and pop-up display would them be configured to be affixed to each other when applied to a package. The panel may be sized to include a greeting or appropriate message printed on the panel providing a greeting card or message appropriate for a specific occasion such as a birthday, anniversary, or other occasion.

An object of the present invention is to provide a decorative dimensional display that can be quickly affixed to a package to provide an attractive display.

Another object of the present invention is to provide a display for a package that can be shipped or transported in a compact configuration in which it can withstand ordinary handling and then be applied to a package to provide a dimensional display.

Yet another object of the present invention to is to provide a decorative dimensional package display that can be shipped in a compact configuration that will permit many different displays to be shipped and displayed together without requiring an unacceptable amount of space.

It is yet another object of the present invention is to provide a decorative dimensional package display that can be specific for many occasions.

These and other objects and advantages of the present invention will be apparent from the embodiments described herein that meet one or more of these objects in whole or in part.

Figure 1:
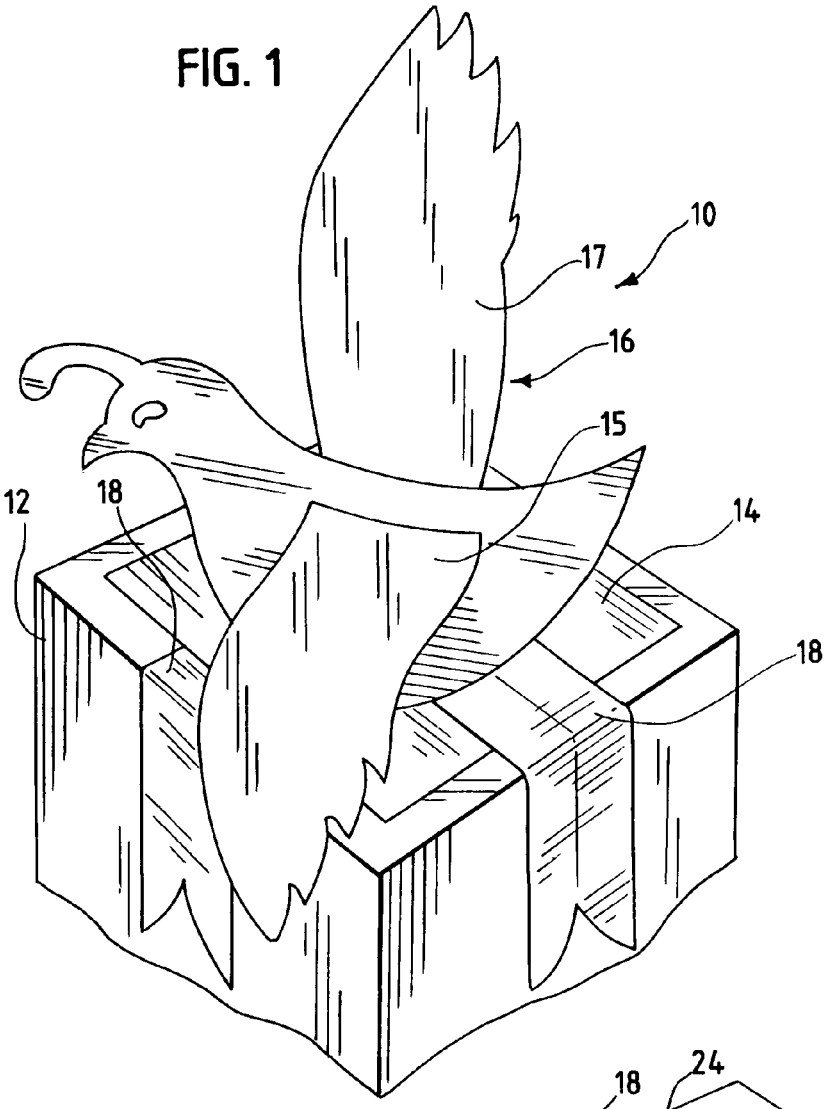
FIG. 1 is an isometric view of a package decoration with a pop-up according to the present invention.

The figures illustrate embodiments of the present invention as presently preferred for use in the illustrated applications. The same numerals are used in the drawings to identify the same or similar elements. The following description of the embodiments illustrated by the figures uses terms such as "top", "bottom", "above", "below", "front", "back", "side" and similar terms to describe the illustrated embodiment in the shown position and configuration. No limitation on the scope of the invention or necessity for the invention is intended by use of these terms. Rather, they are used to facilitate description of illustrated embodiments of the invention.

DETAILED DESCRIPTION OF THE INVENTION

FIG. 1 shows a package decoration with pop-up 10 according to the present invention applied to a box 12. The package decoration with pop-up 10 includes a panel 14 that is sized to overlie a substantial portion of a top of the package 12. The panel 14 may be colored or printed to provide a gift wrapping theme for a holiday or special occasion such as a birthday, anniversary or other occasion. Two ribbons 18 and 19 (shown in partial cutaway) are at right angles to each other, overlie the panel 14 and extend over adjacent edges of the top of the package 12 to extend around the package 12. Preferably, the ribbons are of a color or decoration that is consistent with and enhances the thematic appearance of the panel 14.

The panel 14 is constructed to be foldable, as for example by a foldable material or by creases when the panel 14 is made from stiff paper or cardboard. The panel 14 and ribbons 18 and 19 and are foldable to a configuration that is convenient for shipping and that protects the panel 14, ribbons 18 and 19, and dimensional pop-up 16 from damages in shipping and handling.

A pop-up display 16 representing a bird, such as may be used for a spring bridal shower package, expands from the panel 14 to provide a dimensional decoration on the box 12. The pop-up display 16 is formed of flat foldable material that can be printed, such as paper, and is affixed to the panel 14 to be folded between overlying section of the panel 14. A pop-up display may be formed by joined panels that extend from each other as wings 15 and 17 of pop-up display 16. The pop-up display 16 provides a dimensional display which, in combination with the panel 14 and ribbons 18 and 19, provides a holiday or occasion specific decorative wrapping for the box 12. The pop-up display 16 is made of paper or other material from which a dimensional decoration may be formed by methods conventionally used in construction of folded displays, pop-up books, promotional devices, and other applications in which a dimensional display is formed by expanding from a flat folded configuration.

Figure 2:
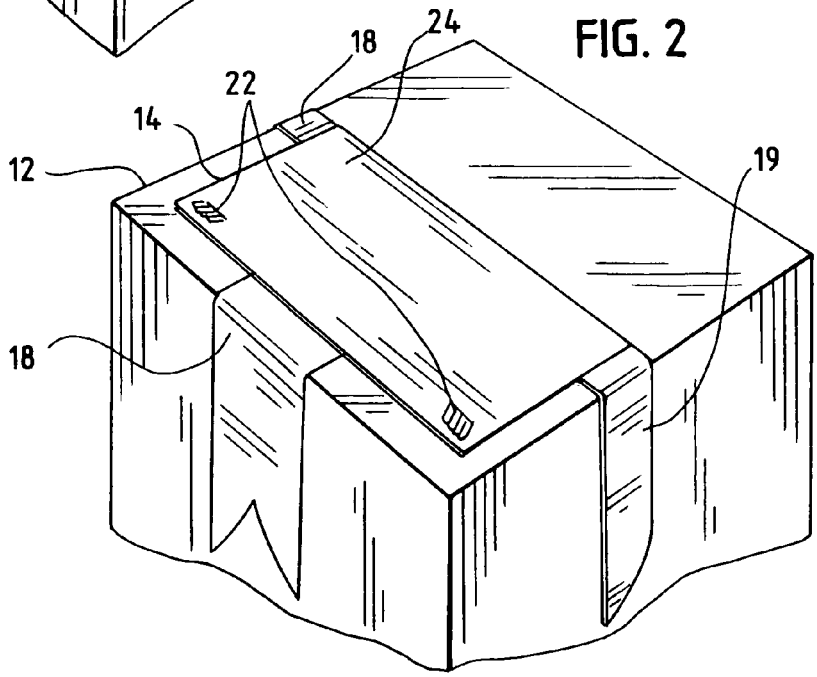
FIG. 2 is an isometric view of a portion of the package decoration shown by FIG. 1 partially affixed to a package.

FIG. 2 illustrates a step in the application of the decoration with pop-up 10 to the box 12. As shown, the panel 14 is folded in half along the length of the ribbon 19 near its center providing a more compact configuration than as shown by FIG. 1. A face 24 of the panel 14 is adjacent to the box 12 when the panel 14 is applied to the box 12. In the folded configuration shown by FIG. 2, half the panel 14 is folded to position the face 24 facing outwardly from the box 12. Adhesive patches 22 are applied to face 24 of the panel 14 to secure the panel 14 to the box 12. As will be understood by those skilled in the art, adhesive patches may be any conventional adhesive appropriate for adhering the panel 14 to the box 12 including double adhesive sided tape. As shown by FIG. 2, an adhesive patch 22 is positioned near each corner of the panel 14 on the face 24.

Figure 3:
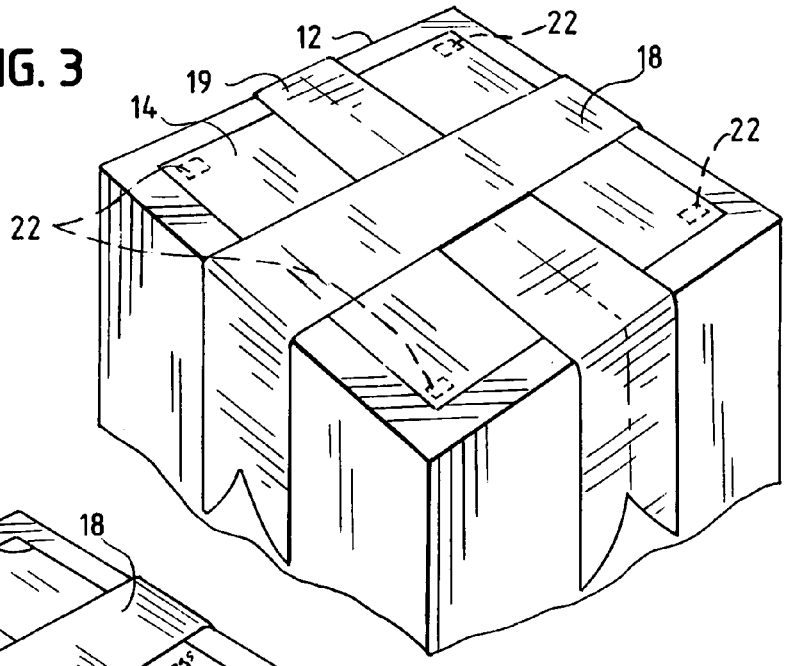
FIG. 3 is an isometric view of a panel portion of the package decoration without the pop-up display as shown by FIG. 1 applied to a package.

FIG. 3 shows the panel 14 unfolded from the configuration shown by FIG. 2 with the pop-up display 16 omitted. The ribbons 18 and 19 cross each other, ribbon 18 overlying ribbon 19, and extend over adjacent sides of the box 12. The panel 14 is held in place by the adhesive patches 22. Alternatively, the panel 14 may be affixed to the package 12 by the ribbons 18 an 19 being adhered to the package 12 or to each other.

Referring again to FIG. 1, the pop-up 16 is constructed so that it may be folded to be flat compact between folded section of the panel 14 for economical packaging and transportation and to avoid damage from ordinary handling. The size, construction, and configuration of the pop-up display 16 are also within knowledge of the those skilled in the art. The pop-up display 16 is affixed to the panel 14 at locations that are appropriate for the particular display as is also well known.

Figure 4:
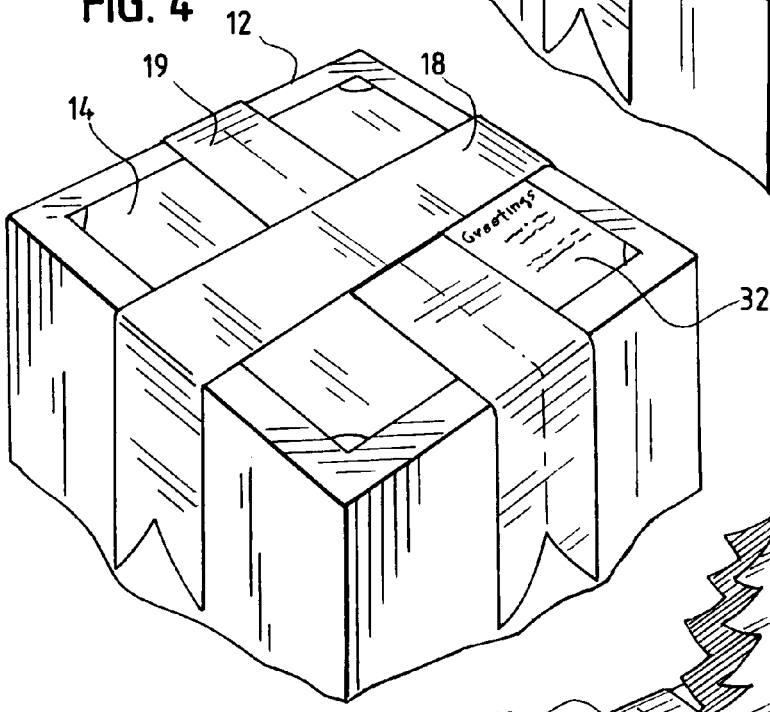
FIG. 4 is an isometric view of a portion of the package decoration including a greeting card.

FIG. 4 shows a panel 14 with a pop-up display omitted and ribbons 18 and 19 affixed to a package 12. The panel 14 includes a greeting card section 32. The greeting card section 32 of the panel includes a preprinted greeting. The greeting card section 32 in this embodiment includes a printed greeting that is appropriate for the theme of the gift wrapping. The greeting card section may include a panel that is printed as greeting card cover and folds away from the panel 14 to provide the appearance of a greeting card.

Figure 5:
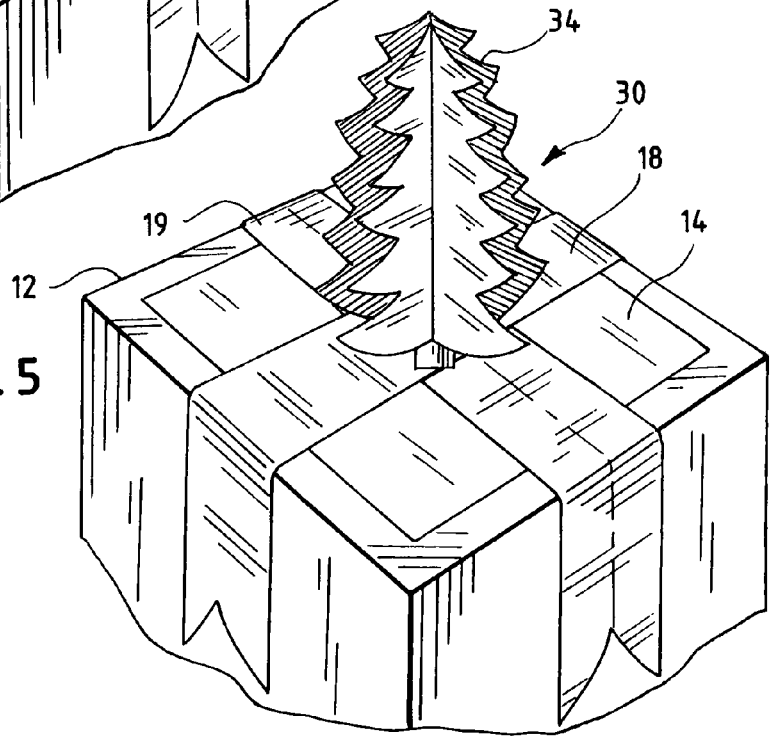
FIG. 5 is an isometric view of another package decoration with a pop-up display according to the present invention.

FIG. 5 shows another package decoration with pop-up 30 according to the present invention applied to a box 12. The decoration with pop-up 30 embodies a Christmas theme and includes a pop-up display 34 in the shape of a Christmas tree. The panel 14 will include a Christmas theme, whether traditional wrapping paper or other holiday specific display, and the ribbons 18 and 19 would also enhance the Christmas theme of the package decoration with pop-up 30.

Figure 6:
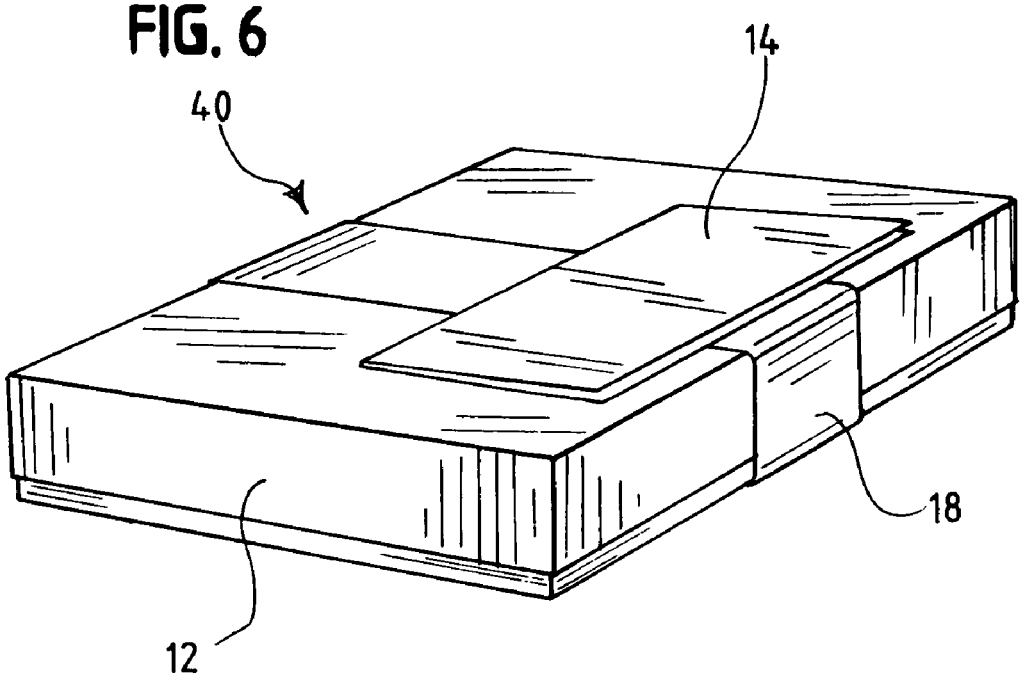
FIG. 6 is an isometric view of a package with another package decoration with a pop-up display according to the present invention that is folded and collapsed.

FIG. 6 shows another package decoration with pop-up 40 according to the present invention applied to a box 12. The decoration with pop-up 40 includes a panel 14 that is shown as folded by FIG. 6 enclosing a collapsed pop-up.

Figure 7:
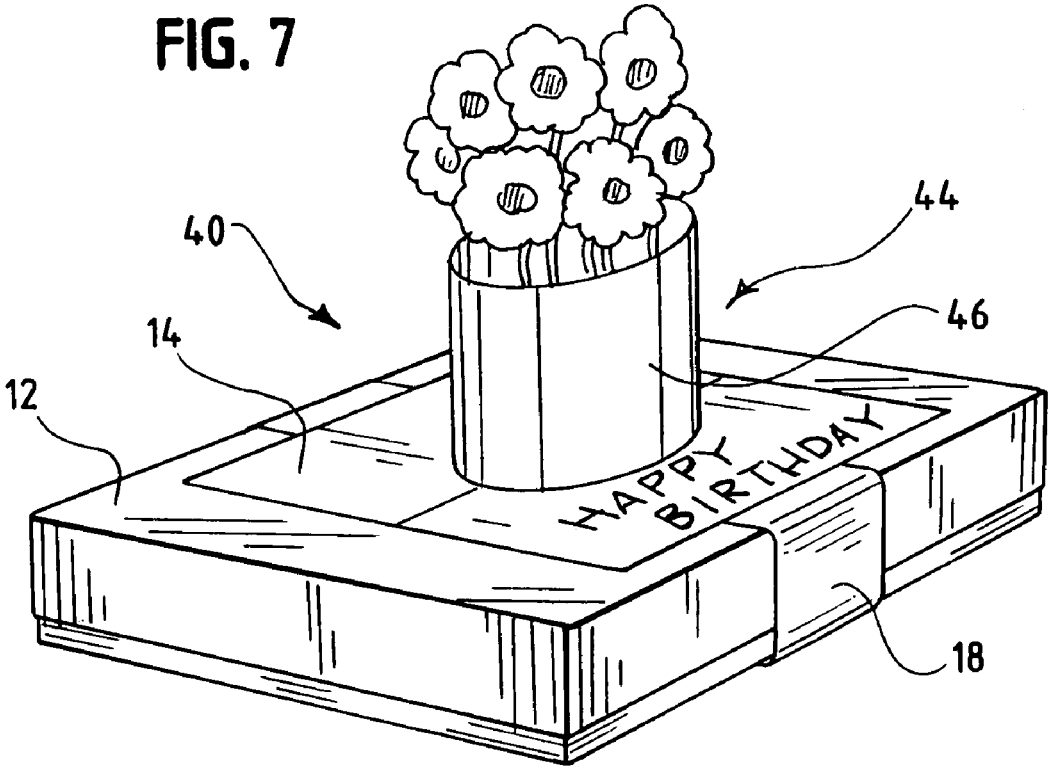
FIG. 7 is an isometric view of the package and package decoration of FIG. 6 expanded to provide a dimensional decorative display.

FIG. 7 shows the package decoration with pop-up 40 that is shown by FIG. 6 after the panel 14 has been unfolded to overlie a surface of the package 12 and the pop-up display 44 has been expanded to provide a dimensional display. Pop-up display 44 forms a decoration that includes a representation of a three dimensional a vase 46 by a panel that generally conforms to the shape of at least a portion of the three dimensional outer surface of a vase.

The present invention has been described by reference to a decorative package wrapping. It will be appreciated by those skilled in the art that the invention may be practiced other than as described. For example, and without limitation, a panel 14 may extend to cover more or less than the side of a box, and may extend to more than one side of a box. Different pop-up displays may be used. Further, while decorative package wrapping is believe to be an important application, the invention is not limited to decorative package wrapping. Other circumstances in which decoration or enhancement of the appearance of a box is desired will also provide applications for the present invention. Such applications may include product packaging and product displays within shipping boxes. Therefore, the invention not be limited to the particular embodiments disclosed. What is sought to be protected is all embodiments falling within the scope of the appended claims.

I claim:

1. A package with a pop-up display decoration comprising:

a package having an outwardly facing side, a foldable panel defining a first section and a second section of the foldable panel, the first section and the second section meeting at and joined to each other along a fold line, the first section and the second section folding along the fold line to face each other, the foldable panel opened to position both the first and second sections of the foldable panel overlying the outwardly facing side of the package, and a pop-up display formed of one or more sheets that are configured to fold into a generally flat and compact configuration, the pop-up display affixed to the first section of the foldable panel at a first location on the pop-up display and the pop-up display affixed to the second section of the foldable panel at a second location on the pop-up display, the pop-up display folds to the generally flat and compact configuration to be at least partially enclosed between the first and second sections of the foldable panel when the foldable panel is folded along the fold line and expands to form a dimensional display when the foldable panel is opened along the fold line to position the first and second sections extending from each other along the fold line.

2. The package with a pop-up display decoration of claim 1 further comprising a band that holds the foldable panel to the package and extends from the panel around the package.

3. The package with a pop-up display decoration of claim 1 wherein the foldable panel includes a greeting card section for displaying a greeting.

4. The package with a pop-up display decoration of claim 2 wherein the foldable panel includes a greeting said section for displaying a greeting.

5. The package with a pop-up display decoration of claim 2 wherein the popup display forms a dimensional display by joined panels.

6. The package with a pop-up display decoration of claim 1 wherein the popup display forms a dimensional display by forming a panel to generally conform to at least a portion of the outer surface of a represented three dimensional object.

7. The package with a pop-up display decoration of claim 4 wherein the popup display forms a dimensional display by forming a panel to generally conform to at least a portion of the outer surface of a represented three dimensional object.

8. The package with a pop-up display decoration of claim 1 wherein the pop-up display forms a dimensional display by forming two or mote joined panels to generally conform to at least a portion of the outer surface of a represented three dimensional object.

9. The package with a pop-up display decoration of claim 4 wherein the band is a ribbon.

10. A method for decorating a package comprising the steps of providing a pop-up display package decoration having a foldable panel sized to overlie a portion of a package and a pop-up display that is affixed to the foldable panel and is formed of one or more sheets that are configured to fold into a generally flat and compact configuration when the foldable panel is folded, the foldable panel defining a first section and a second section that meet at and are joined to each other at a fold line and the pop-up display is affixed to the first section of the foldable panel at a first location on the pop-up display and is affixed to the second section of the foldable panel at a second location on the pop-up display, the pop-up display expands from the flat and compact configuration to form a three dimensional display when the foldable panel is opened, opening the foldable panel to form the pop-up display into the three dimensional display, positioning both sections of the foldable panel of the pop-up display package decoration on an outwardly facing side of a package, and causing the foldable panel to engage the outwardly facing side of the package to resist movement on the package.

11. A method for decorating a package comprising the steps of providing a pop-up display package decoration having a foldable panel sized to overlie a portion of a package and a pop-up display that is affixed to the foldable panel and is formed of one or more sheets that are configured to fold into a generally flat and compact configuration when the foldable panel is folded, the foldable panel defining a first section and a second section that meet at and are joined to each other at a fold line and the pop-up display is affixed to the first section of the foldable panel at a first location on the pop-up display and is affixed to the second section of the foldable panel at a second location on the pop-up display, the pop-up display expands from the flat and compact configuration to form a three dimensional display when the foldable panel is opened, opening the foldable panel to form the pop-up display into the three dimensional display, positioning the oop-un display package decoration on a package, and causing the foldable panel to engage the package to resist movement on the package by providing a band that is sized to extend at least partially around the package, causing the band to engage the pop-up display package decoration, and extending the band at least partially around the package to secure the pop-up display package decoration to the package.

12. The method for decorating a package of claim 11 wherein the band that is provided by the step of providing a band that is sized to extend around the package is a ribbon and wherein the step of causing the band to engage the pop-up display package decoration includes causing the band to overlie the foldable panel.

13. The method for decorating a package of claim 10 wherein the foldable panel includes a greeting card section displaying a greeting and wherein the popup display forms a dimensional display by forming a panel to generally conform to at least a portion of the outer surface of a represented three dimensional object.

14. The method for decanting a package of claim 10 wherein the step of causing the foldable panel to engage the package comprises providing a foldable panel that is constructed to engage the package to resist movement on the package.

* * * * *

UNITED STATES PATENT AND TRADEMARK OFFICE

CERTIFICATE OF CORRECTION

PATENT NO. : 7,111,736 B2
APPLICATION NO. : 10/817093
DATED : September 26, 2006
INVENTOR(S) : Marta Petter It is certified that error appears in the above-identified patent and that said Letters Patent is hereby corrected as shown below:

Column 6, line 24, please delete “mote” and insert --more--;

Column 8, line 12, please delete “decanting” and insert --decorating--.

Signed and Sealed this

First Day of May, 2007

JON W. DUDAS
*Director of the United States Patent and Trademark Office*